US007950620B2

(12) United States Patent
Knight

(10) Patent No.: US 7,950,620 B2
(45) Date of Patent: May 31, 2011

(54) AIR CONDITIONER CONDENSER PLATFORM

(76) Inventor: Dan Knight, Nixa, MO (US)

( * ) Notice: Subject to any disclaimer, the term of this patent is extended or adjusted under 35 U.S.C. 154(b) by 28 days.

(21) Appl. No.: 12/380,459

(22) Filed: Feb. 26, 2009

(65) Prior Publication Data

US 2009/0260383 A1 Oct. 22, 2009

Related U.S. Application Data

(60) Provisional application No. 61/124,669, filed on Apr. 18, 2008.

(51) Int. Cl.
*F16M 11/00* (2006.01)

(52) U.S. Cl. ..... 248/676; 248/143; 248/237

(58) Field of Classification Search ..... 248/676, 248/148, 143, 237; 52/27
See application file for complete search history.

(56) References Cited

U.S. PATENT DOCUMENTS

| | | | | | |
|---|---|---|---|---|---|
| 3,742,659 | A * | 7/1973 | Drew | 52/19 |
| 5,454,538 | A * | 10/1995 | Merideth | 248/237 |
| 5,474,271 | A * | 12/1995 | Raymond | 248/237 |
| 5,570,864 | A * | 11/1996 | Flores | 248/148 |
| 6,343,439 | B1 * | 2/2002 | Rutledge | 52/27 |
| 2002/0027091 | A1 * | 3/2002 | Brown | 206/372 |
| 2005/0223660 | A1 * | 10/2005 | Henning et al. | 52/203 |
| 2006/0226310 | A1 * | 10/2006 | Hall et al. | 248/148 |
| 2008/0105489 | A1 * | 5/2008 | Garrett | 182/45 |
| 2009/0211177 | A1 * | 8/2009 | Grafton et al. | 52/93.1 |

* cited by examiner

*Primary Examiner* — Ramon O Ramirez
(74) *Attorney, Agent, or Firm* — Lathrop & Gage LLP

(57) ABSTRACT

An air conditioner condenser platform is described for supporting an air conditioner condenser installed on a roof. The platform provides a fixed base and an adjustable platform whereby the fixed base is installed on the roof and the adjustable platform is configured to provide a level platform on which to install the condenser. It provides a durable metal weather resistant platform on which to install the condenser, and a standard platform that may be quickly installed in a variety of roof slopes and configurations.

4 Claims, 4 Drawing Sheets

AIR CONDITIONER CONDENSER PLATFORM

RELATED APPLICATIONS

This application claims priority to U.S. Provisional Patent Application Ser. No. 61/124,669 filed Apr. 18, 2008, the disclosure of which is incorporated herein by reference.

BACKGROUND

Field of the Invention

Air conditioner condensers are utilized in air conditioning systems and, in many commercial buildings, and are typically installed on the roof of the building in which they are to be utilized. Such condensers must be installed on a level surface in order to ensure the proper operation of the condenser and the long term functioning of the system. Since the roofs of commercial buildings are often not completely flat, and may incorporate a certain slope to promote water runoff, the installation of air conditioner condensers on the roofs of commercial buildings often requires that platforms be constructed to provide a level surface on which to place the condenser.

Generally the necessary platforms are constructed directly on the roof or on the job site to match the roof slope of the particular installation site. Varying roof slopes require each platform to be designed to and built to satisfy the specific installation site. The platforms are often constructed of wood and, as a result are subject to rot or to be otherwise compromised from exposure to the weather and elements. They are also not consistently built with a stable design, thus creating problems with the long-term quality and durability of the platforms.

It is therefore desirable to provide an air conditioner condenser platform which allows for the efficient, cost effective, stable and durable mounting of an air conditioner condenser on roofs of varying slopes. It is further desired to provide an air conditioner condenser platform that may be pre-manufactured and adjusted for installation on a wide variety of roof slopes. If is further desired that the air conditioner condenser platform be constructed from materials that are weather resistant.

SUMMARY OF THE INVENTION

An air conditioner condenser platform is provided for mounting an air conditioner condenser to a roof in a horizontal position comprising a fixed base and an adjustable mounting platform. A fixed base is provided with support members for securely mounting the platform on roofs of varying slopes. A mounting platform is then adjustably attached to the fixed base to allow the mounting platform to be installed in a horizontally level position and then secured to the fixed base. The mounting platform then provides a secure, level platform for mounting the air conditioner condenser.

The air conditioner condenser platform disclosed herein is constructed of metal or other similar durable and weather-resistant materials. It is also designed to provide for the quick and reliable installation of a level platform in a variety of roof settings and configurations.

DETAILED DESCRIPTION

Figure 1:
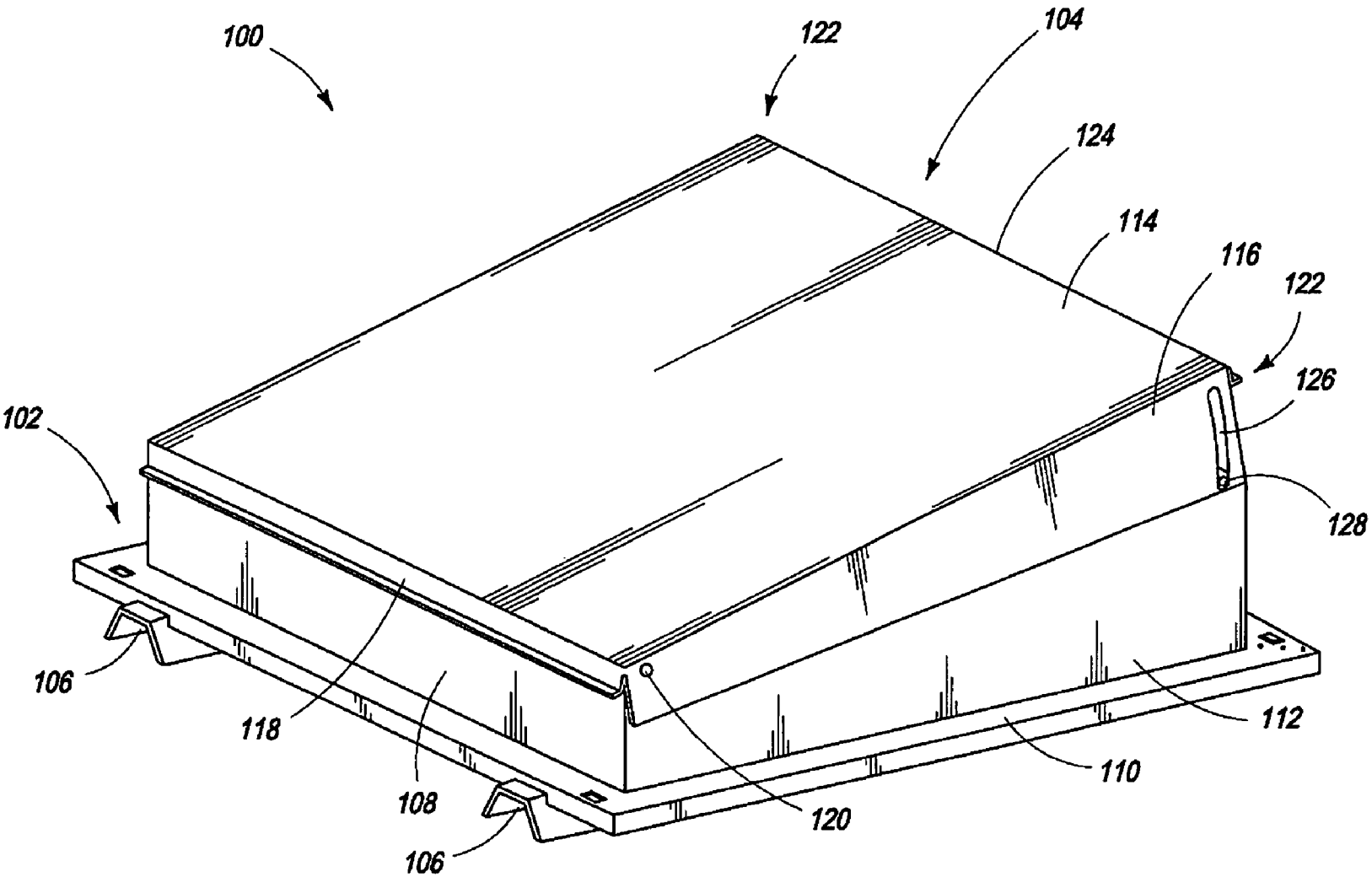
FIG. 1 is a perspective view of an embodiment of the air conditioner condenser platform.

Referring now to FIG. 1, a perspective view of an embodiment of the air conditioner condenser platform 100 is shown. An embodiment of the condenser platform 100 comprises a fixed base 102 and an adjustable mounting platform 104. The fixed base 102, in one embodiment, comprises a plurality of support members 106. In one embodiment the support members are formed of metal delineator posts, channel or tubing of varying cross-sections, including box and u-shaped channel members. The fixed base 102 further comprises support box 108 formed from sheet metal that is affixed to support members 106. Support box 108 is composed of sheet metal folded into a lip 110 and sides 112 and further folded to form an open top and open bottom box 108. When installed on a roof the support members 106 or the lip 110 are affixed to the roof to provide support to the air conditioner condenser platform 100 and to fix it in the desired location on the roof. In one embodiment of the air conditioner condenser platform, when the platform 100 is installed on a roof, support members 106 are disposed parallel to the gradient of the slope of the roof.

The mounting platform 104 is formed from sheet metal into a top panel 114 of substantially rectangular shape, and side panels 116. Side panels 116 are disposed along two opposing edges of top panel 114 and are disposed substantially perpendicular to the surface of top panel 114. The platform 104 may also incorporate formed or folded edges and other support elements to increase the rigidity and stability of the platform 104.

The platform 104 is rotateably attached to the fixed base 102 to provide for rotational adjustment of the mounting platform 104 along a first edge 118 of the mounting platform 104. The rotateable attachment in one embodiment of the invention comprises bolts fastened through bolt holes 120 located at the corners of the mounting platform 104 in side panels 116 and in sides 112 of box 108, however in other embodiments of the invention a hinge along edge 118, pins or other rotateable connectors may be utilized with similar results. The bolt holes 120 provide a rotateable connection between side panels 116 and sides 112 of support box 108.

When the platform 100 is installed on a roof, the first edge 118 is disposed perpendicular to the gradient of the roof. This allows the mounting platform 104 to be rotateably adjusted with respect to base 102 so that the plane of the surface of top panel 114 is horizontal.

The platform 104 is also releasably and adjustably attached to the fixed base 102 at corners 122 located near a second edge 124 of mounting platform 104 on side panels 116. The releasable attachment between fixed base 102 and mounting platform 104 at corners 122 provides for the rotation of mounting platform 104 around first edge 118.

In one embodiment the releasable attachment comprises a curved slot 126 in side panels 116 and bolt holes 128 in corners 122 of support box 108. The angular position of mounting platform 104 with respect to fixed base 102 may be altered by adjusting the relative angular position of mounting platform 104 with respect to fixed base 102 and fixing it in place by means of bolts affixed through slots 126 and holes 128.

Figure 2:
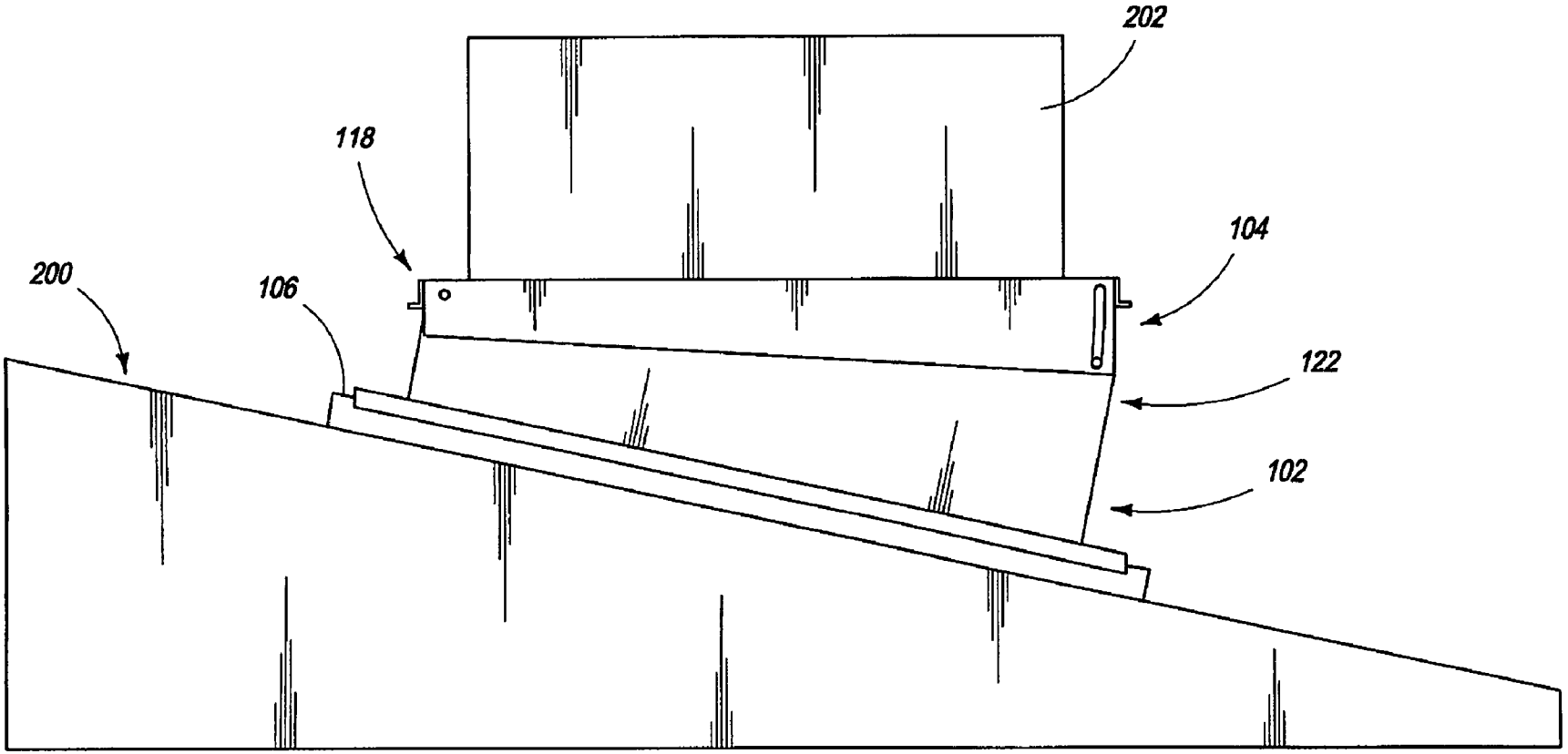
FIG. 2 is a side view of an embodiment of the air conditioner condenser platform installed on a roof.

Referring now to FIG. 2, a side view of the present invention is shown as installed on a roof 200. Fixed base 102 is shown attached to the roof 200. In this embodiment of the condenser platform 100, it is installed with support members 106 parallel to the gradient of the roof 200, however in other embodiments the support members 106 may be perpendicular to the gradient of the roof 200. The first edge 118 must be perpendicular to the gradient of the roof 200.

After the base 102 has been secured to the roof 200, the connections at corners 122 are released, and edge 124 of mounting platform 104 is raised or lowered until the top panel 114 is perfectly horizontal. The connections at corners 122 are then tightened by bolts, washers and nuts inserted through slots 126 and holes 128. Once top panel 114 is level and mounting platform 104 is fixed in relation to the fixed base 102, an air conditioner condenser 202 may be installed on the platform 100. Any bolt holes or other mounting attachments for condenser 202 may be attached to the top surface 114 of platform 100.

Figure 3:
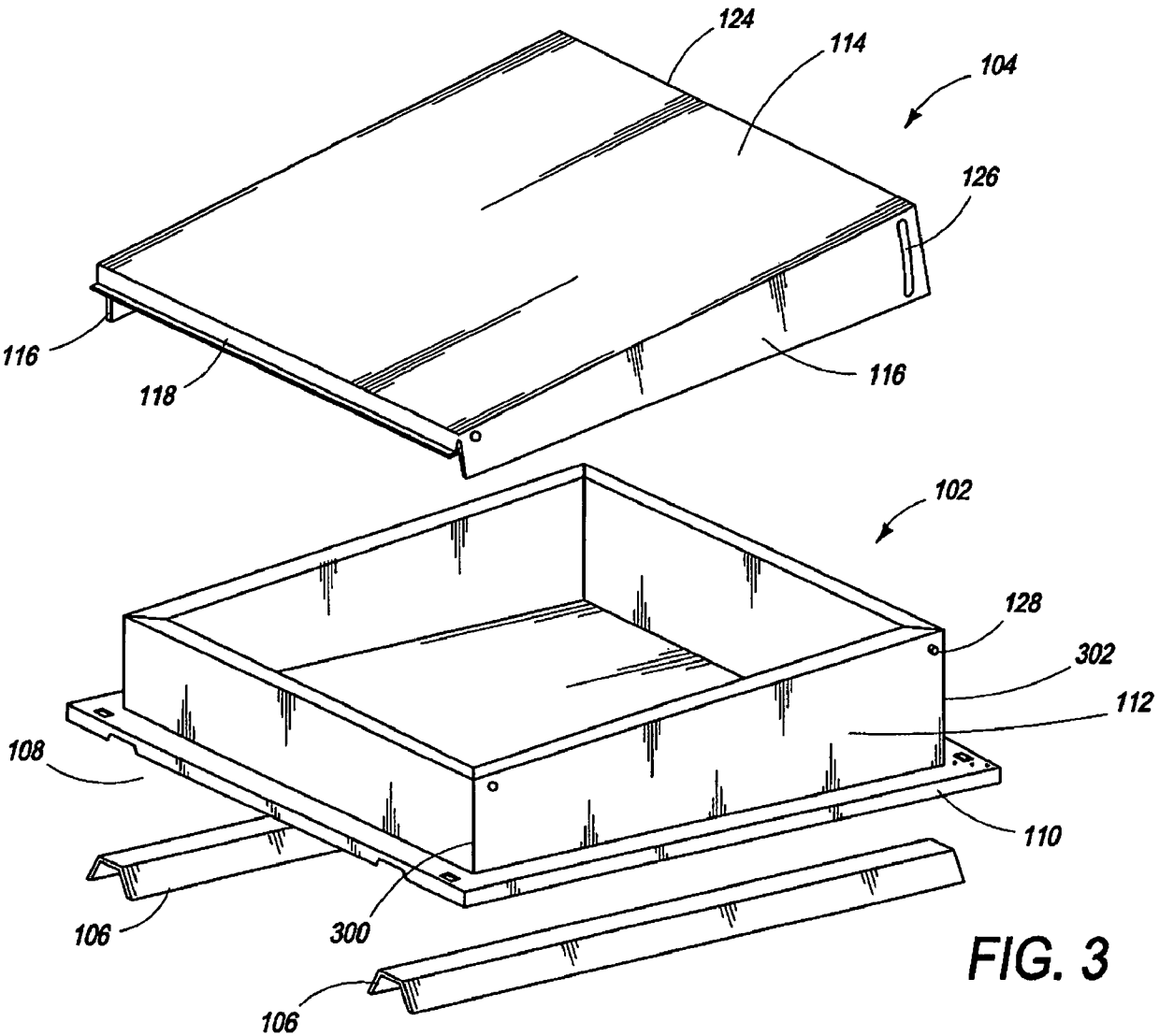
FIG. 3 is an exploded view of an embodiment of the air conditioner condenser platform.

Referring now to FIG. 3, an exploded view of an embodiment of the invention is shown. The elements of the embodiment are labeled and correspond to the elements discussed above in relation to FIG. 2. For purposes of clarity, the bolt and other fasteners that attach the various parts together are omitted. These fasteners may be of any type known for fastening sheet metal together, including, but not limited to, bolts, screws, welding, riveting.

As may be seen more clearly in FIG. 3, the side panels 112 of fixed base 102 may be trapezoidal in shape. In the embodiment shown in FIG. 3, edge 300 of side panel 112 is shorter than edge 302 of side panel 112. The angle of the trapezoidal side panel 112 reduces the angle that has to be compensated for by the adjustment of top panel 114, thus allowing it to be used on a roof with a steeper gradient that might otherwise be possible.

Figure 4:
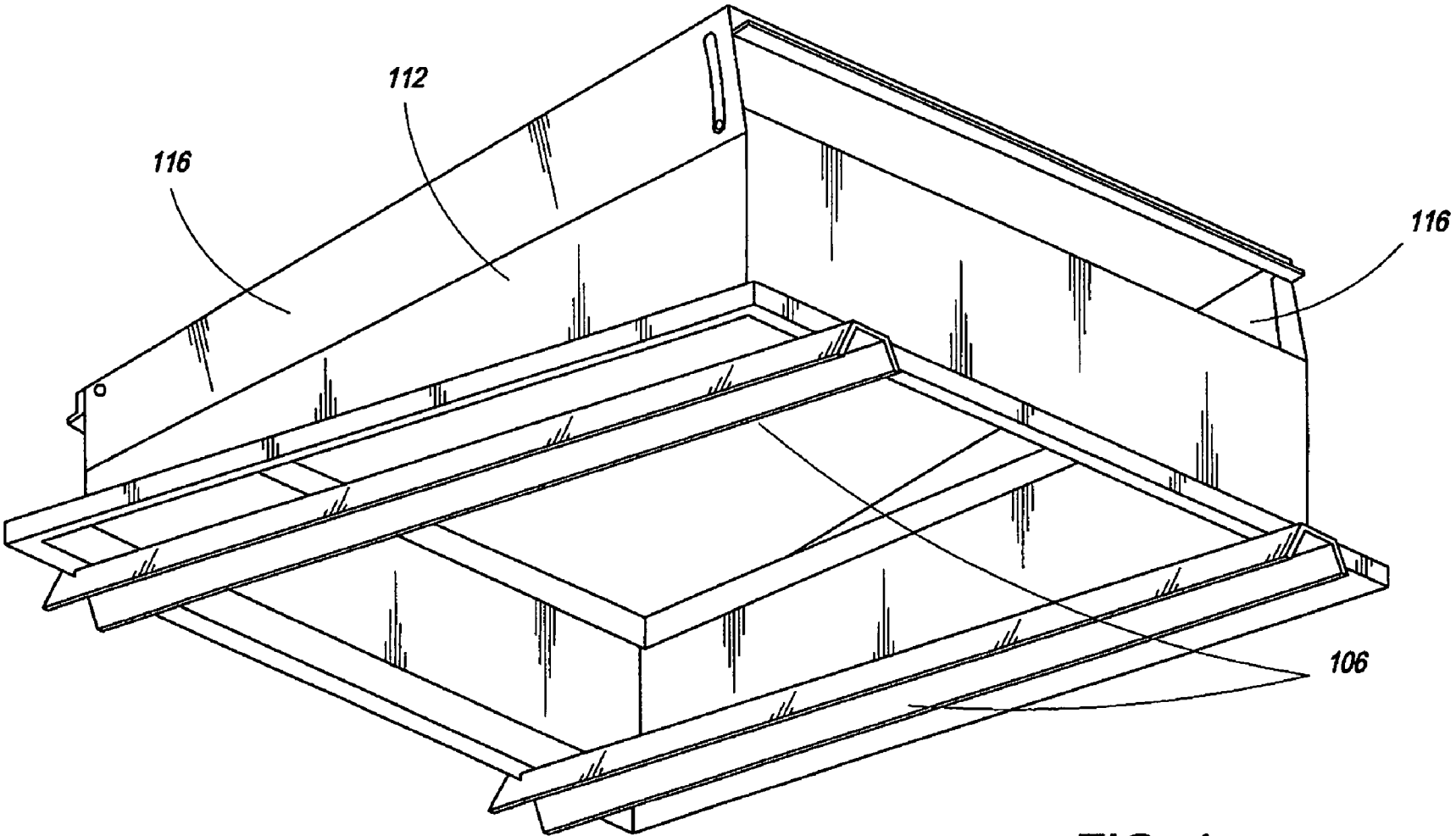
FIG. 4 is a perspective view of an embodiment of the air conditioner condenser platform.

Referring now to FIG. 4, a second perspective view provides a view of the bottom of the air conditioner condenser platform and the interior of support box 108. FIG. 4 also shows the two side panels 116 with releasable attachments at both corners 122 of edge 124 of mounting platform 104. Support members 106 are shown situated parallel to sides 112, but could also be mounted perpendicular to sides 112.

What is claimed is:

1. An air conditioner condenser platform comprising:

a fixed base for attaching to a roof, the fixed base having a first edge and an opposing second edge;

and an adjustable mounting platform;

wherein the adjustable mounting platform is rotateably attached to the fixed base near the first edge and releaseably attached to the fixed base near the second edge through a releaseable attachment;

wherein the fixed base further comprises at least one support member and a support box comprising a first and second side panels, a front panel and a back panel;

wherein the adjustable mounting platform further comprises a top panel, two side panels disposed substantially perpendicular to the top panel, and a first edge and a second edge of the top panel both disposed substantially perpendicular to the side panels; and wherein the releaseable attachment comprises:

a first curved slot in the first side panel and a second curved slot in the side panel of the adjustable mounting platform near the second edge of the top panel;

a first bolt hole in the first side panel and a second bolt hole in the second side panel of the support box near the second edge of the fixed base; and a first bolt secured through the first curved slot and first bolt hole, and a second bolt secured through the second curved slot and second bolt.

2. The platform of claim 1, wherein the first and second side panels of the mounting platform have trapezoidal shape.

3. The platform of claim 1, wherein the first and second side plates of the support box have trapezoidal shape.

4. A method for mounting an air conditioner condenser on a roof comprising the steps of:

providing a fixed base having a first and an opposing second edges and a first and a second side plates, wherein the first and second side plates have bolt holes near the second edge of the fixed base;

mounting the fixed base on the roof;

providing an adjustable mounting platform having a top panel with a first edge and an opposing second edge, and a first and a second side panel, wherein the first and second side panels have a first and second curved slots near the second edge of the top panel;

rotateably attaching the first and second side panels of the adjustable mounting platform to the respective first and second side plates of the fixed base near the first edges of the fixed base and top panel;

adjusting respective positions of a first and second bolts within respective first and second curved slots such that the top panel of the mounting platform is in a horizontal level position;

securing the adjustable mounting platform to the fixed base through the first and second bolts in the first and second curved slots and respective bolt holes;

mounting the air conditioner condenser on the top panel of the adjustable mounting platform.

* * * * *